US005113176A

United States Patent [19]

Harris

[11] Patent Number: 5,113,176

[45] Date of Patent: May 12, 1992

[54] LUMBAR ROLL WITH AUDIBLE ALERTING CAPABILITY

[75] Inventor: Frank W. Harris, Boulder, Colo.

[73] Assignee: Staodyn, Inc., Longmont, Colo.

[21] Appl. No.: 612,611

[22] Filed: Nov. 13, 1990

[51] Int. Cl.[5] ..... G05B 21/00

[52] U.S. Cl. ..... 340/573; 340/667

[58] Field of Search ..... 340/573, 667

[56] References Cited

U.S. PATENT DOCUMENTS 4,007,733 2/1977 Celeste et al. ..... 340/573

4,638,307 1/1987 Swarthout ..... 340/667

FOREIGN PATENT DOCUMENTS 2103853 2/1983 United Kingdom ..... 340/667

OTHER PUBLICATIONS

Roemer, R. et al. "Warning Device for the Prevention of Ischaemic Ulcers in Quadriplegics," Medical & Biological Engineering, VIV, 5, pp. 580-581, Sep. 1976, London, Eng.

*Primary Examiner*—Glen R. Swann, III

*Attorney, Agent, or Firm*—Robert E. Harris

[57] ABSTRACT

The lumbar roll is particularly usable by a person seated for extensive periods of time, as, for example, a computer operator, to alert the user to various conditions such as poor posture and/or a need to exercise. The lumbar roll includes a piece of foam material surrounded by a zippered casing of nylon or the like. A battery powered electronic unit is encased in the foam material, and a pressure switch is also positioned in the foam material so that the switch is closed by user pressure exerted on the roll. After user pressure closes the pressure switch, the electronic unit turns on and timers are activated to provide an audible alert if the pressure switch should open for a predetermined period of time thereafter to indicate a condition such as poor posture, for example, or if the pressure switch is not opened for a predetermined period of time thereafter to provide a different audible alert of a second condition such as a need for exercise, for example. Automatic shut-off occurs when no pressure is sensed by the detector for a predetermined period of time.

19 Claims, 3 Drawing Sheets

LUMBAR ROLL WITH AUDIBLE ALERTING CAPABILITY

FIELD OF THE INVENTION

This invention relates to a lumbar roll and, more particularly, relates to a lumbar roll having an audible alerting capability.

BACKGROUND OF THE INVENTION

Back pain and neck pain result from sitting with bad posture for too long in a fixed position, as, for example, occurs when a computer operator sits at a computer terminal with bad posture. The most common posture problem is that such an operator will allow the head to protrude forward to stare at the screen. This awkward position can lead to stiff muscles and damage to the cervical spine cartilage and bone. With good posture, the weight on the head (20 pounds for example) remains retracted over the neck and shoulders where little force is required to keep it in place.

Another aspect of the problem is that many computer operators stare so intently at the screen that muscles become tight and sore from lack of motion. Ideally, a computer operator, who is suffering from these problems, should stop and do some simple stretching and range-of-motion exercises every few minutes (such as about every 10 to 15 minutes).

A lumbar roll is a useful aid in achieving good posture and treating back pain. The roll generally has a strap that slips over the back of a chair and holds the roll about six inches above the seat. When the operator sits down, the lumbar roll should firmly press against the small of the back. Providing the person is seated far enough back in the chair, the lumbar roll forces the lumbar region forward, causing the user to sit erect.

The limitation of the lumbar roll is that there is nothing to compel the user to sit far enough back in the chair. It is easy to slouch in the chair as if the roll were not there. Slouching temporarily feels better and is the natural posture for someone with a slouching habit. Moreover, a computer operator, for example, is normally hard at work and not thinking about posture and this worsens back and neck problems. No matter how sincere such an operator might be about changing habits, concentrating on the computer screen makes the operator forget about posture and exercise.

SUMMARY OF THE INVENTION

This invention provides an improved lumbar roll having the capability to provide an audible indication to a user to alert the user to one or more conditions, such as, for example, poor posture and/or a need for exercise. The roll includes a foam rubber encased, battery-powered electronics unit connected with a pressure switch, the closing of which automatically turns on the electronics unit and activates timers therein, and the opening of which for a predetermined time period causes the electronic unit to be automatically turned off. A first audible alert is provided if a pressure switch is thereafter opened for a short predetermined period of time to indicate a first condition, such as, for example, poor posture, and a second audible alert is provided if a pressure switch remains closed for a longer predetermined time period to indicate a second condition, such as, for example, a need for exercise.

It is therefore an object of this invention to provide an improved lumbar roll.

It is another object of this invention to provide an improved lumbar roll with audible alerting capability.

It is still another object of this invention to provide an improved lumbar roll with an electronics unit controlled by a pressure switch and timers to provide an audible alert to a user.

It is still another object of this invention to provide an improved lumbar roll with audible alerting capability to provide an audible alert to a user utilizing a plurality of different audible signals to indicate different conditions, such as, for example, to signal to poor posture and a need to exercise.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which.

DESCRIPTION OF THE INVENTION

Figure 1:
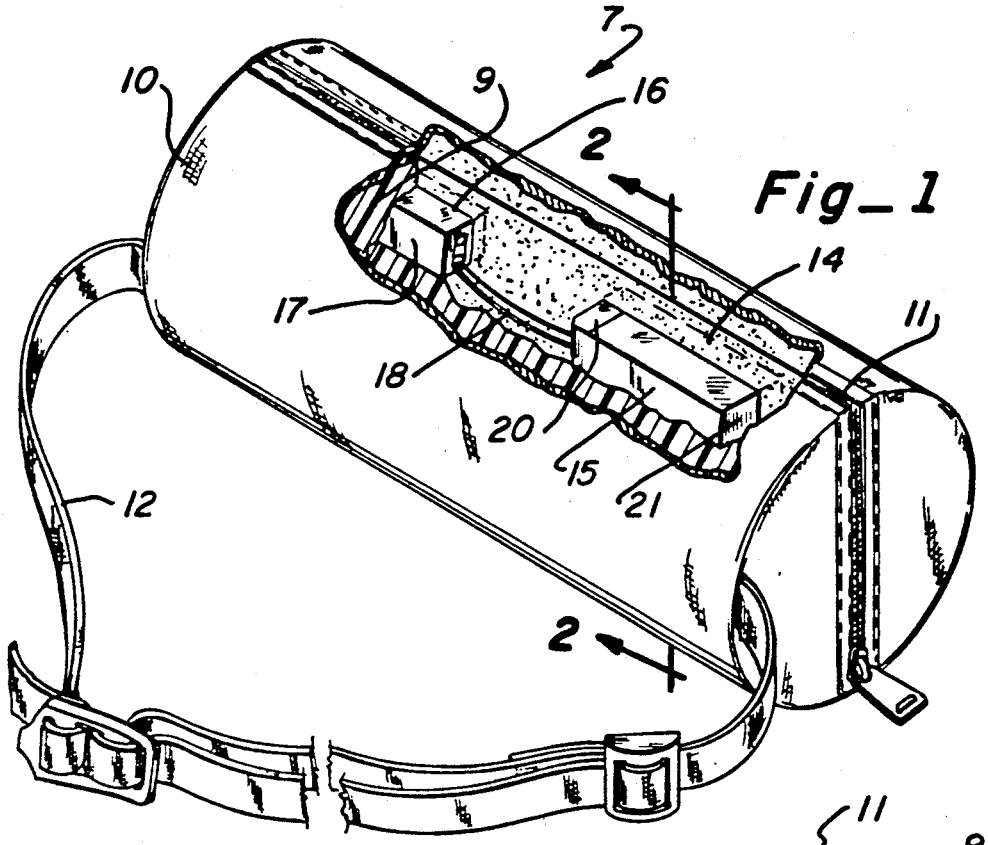
FIG. 1 is a cut-away perspective view of the lumbar roll of this invention.

As shown in FIG. 1, lumbar roll 7 includes a piece, or section, of readily compressible foam material 9, preferably having a circular cross-section. The foam rubber material has an outer casing 10, preferably of a material, such as nylon, canvas, or the like, surrounding the foam rubber section. Casing 10 has a zipper 11 extending across the length and one side of the roll for allowing access into the interior of the roll. Adjustable strap 12 is provided for positioning the roll on a chair or the like.

Figure 2:
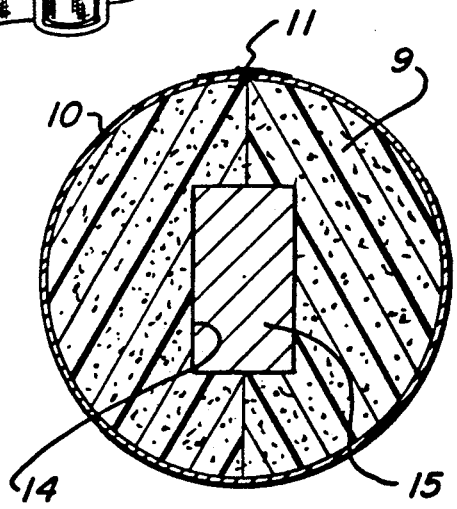
FIG. 2 is a sectional view taken through lines 2—2 of FIG. 1.

As illustrated in FIGS. 1 and 2, foam material 9 has a cavity 14 therein to receive electronics unit 15 and a cavity 16 to receive a battery 17 for powering the electronic unit through leads 18. A pressure switch 20 is provided either on the exterior of casing 21 of the electronics unit, or separately of the electronics unit with electrical leads extending thereto, with the pressure switch being preferably near the edge of the roll to be brought into contact with the user of the roll. It is to be realized that a plurality of pressure switches could be utilized, if desired.

The now preferred embodiment of the pressure switch is based on a commercial push-button, printed circuit board mounted, momentary contact switch. The switch can be mounted on the printed circuit board with the rest of the electronics so that the switch is closed when the user exerts force on the foam material. While not shown, a flat, stiff plate that pushes the momentary switch button when the foam is compressed can be utilized to assure proper switch closure. If such a plate is large, compression forces over a wide area of the lumbar roll will cause the switch to close.

The pressure switch could also be made from pieces of conductive rubber placed in a cavity cut into the foam rubber. When the foam rubber is compressed, the pieces of conductive rubber will touch and make electrical contact. This design has a disadvantage that the contact resistance is rather high (1K to 5K ohms) and could result in the flip/flop not being set properly.

In addition, multiple membrane switches glued to the inside of the casing of the roll can be wired in parallel and made to detect pressure from more than one direction. However, after the lumbar roll has been compressed, the pieces of foam rubber can migrate slightly and could put tension on the membrane switches or bend them so that they are locked on even after the external pressure has been released.

As can be appreciated from the foregoing, an audible alarm, or alert, is added to a conventional lumbar roll to remind a user, such as, for example, a computer operator of predetermined conditions, such as, for example, when not sitting properly and/or when it is time to stretch and/or perform exercises. The audible alert is effected through use of a pressure switch, battery, and electronics unit mounted inside the lumbar roll with the pressure switch being preferably mounted inside the forward half of the roll.

When the user leans firmly against the roll, the switch will close informing the electronics unit that the roll is being used correctly. When the operator slouches, the pressure on the pressure switch drops, and the alert alarm sounds, encouraging the operator to straighten up. The tone of the alarm is preferably moderately high pitched and somewhat insistent.

The instrumentation is preferably automatic to make the device as practical as possible. Several electronic features are incorporated into the unit to make the unit user friendly and more likely to be used.

Figure 3:
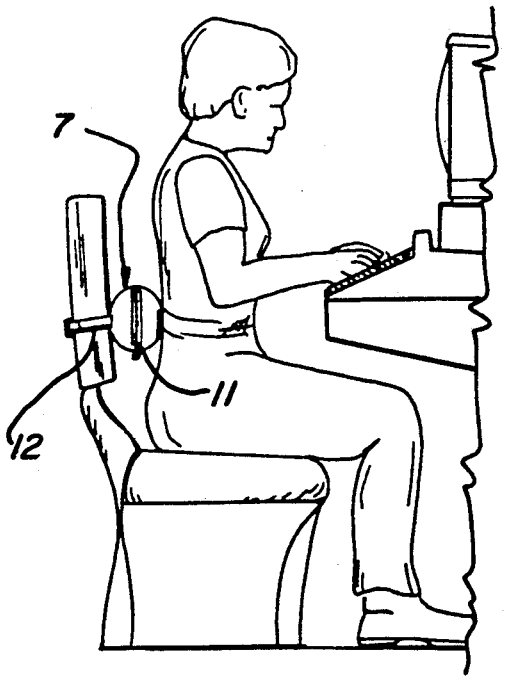
FIG. 3 is a side view illustrating use of the lumbar roll by a computer operator.

When the operator first sits at the chair, as illustrated in FIG. 3, the operator presumably will be interested enough in posture to lean back firmly against the roll at least for a few moments. This first detection of pressure on the switch causes the electronics to "wake-up" and automatically turn on. This saves battery power by not requiring the electronics be on continuously. Moreover, not having to manually turn on the electronics makes it more likely that the instrumentation feature will be used.

The alert alarm beeper is delayed so that a few seconds of bad posture will be tolerated before the operator is annoyed with the beep, and will also allow the operator the chance to release pressure on the lumbar for a short time for other reasons such as, for example, to reach over and pick up a phone without causing the alert alarm beeper to sound.

After the pressure switches have detected loss of pressure for several seconds, which can occur, for example, if the operator leaves the chair for a short time, the alert alarm begins to beep. This beep is limited in time, for example to 5 seconds, to avoid undue annoyance to the operator (or those around the operator).

The beeper alarm could be less objectionable by ramping the sound up slowly. It should not blast away immediately at full volume, particularly since this would annoy others working in the area. A sophisticated beeper could be used to automatically adjust the sound level to the background noise level of the room.

Every few minutes, for example, every 10 to 30 minutes, a different sound informs the user that it is time for stretching exercises. At the conclusion of this alarm, the exercise timer resets and remains quiet until the next time period of 10 to 30 minutes has elapsed. In a working embodiment, the exercise reminder beeper is low pitch and makes two beeps lasting a total of about two seconds.

There are different thoughts about how often an exercise timer should sound. One though is that the exercises should be done about every 10 minutes or so, while another thought is that the computer operator can't stand interruptions more than about once every half hour. After such an interval of about one-half hour, it is felt that the operator should get up and walk around a bit as well as performing stretching exercises.

In practice, a computer operator could use the exercise reminder timer as a useful tool for other purposes, such as, for example, to save the computer file. Many operators are plagued with power interruptions, software traps, intermittent monitors, and other trouble that could cause the work in progress to be lost. By saving routinely every few minutes, significant work is rarely lost.

If there has been no pressure on the roll detector for a total of 10 seconds, the electronics automatically shuts off and waits for the next pressure switch closure.

Figure 4A:
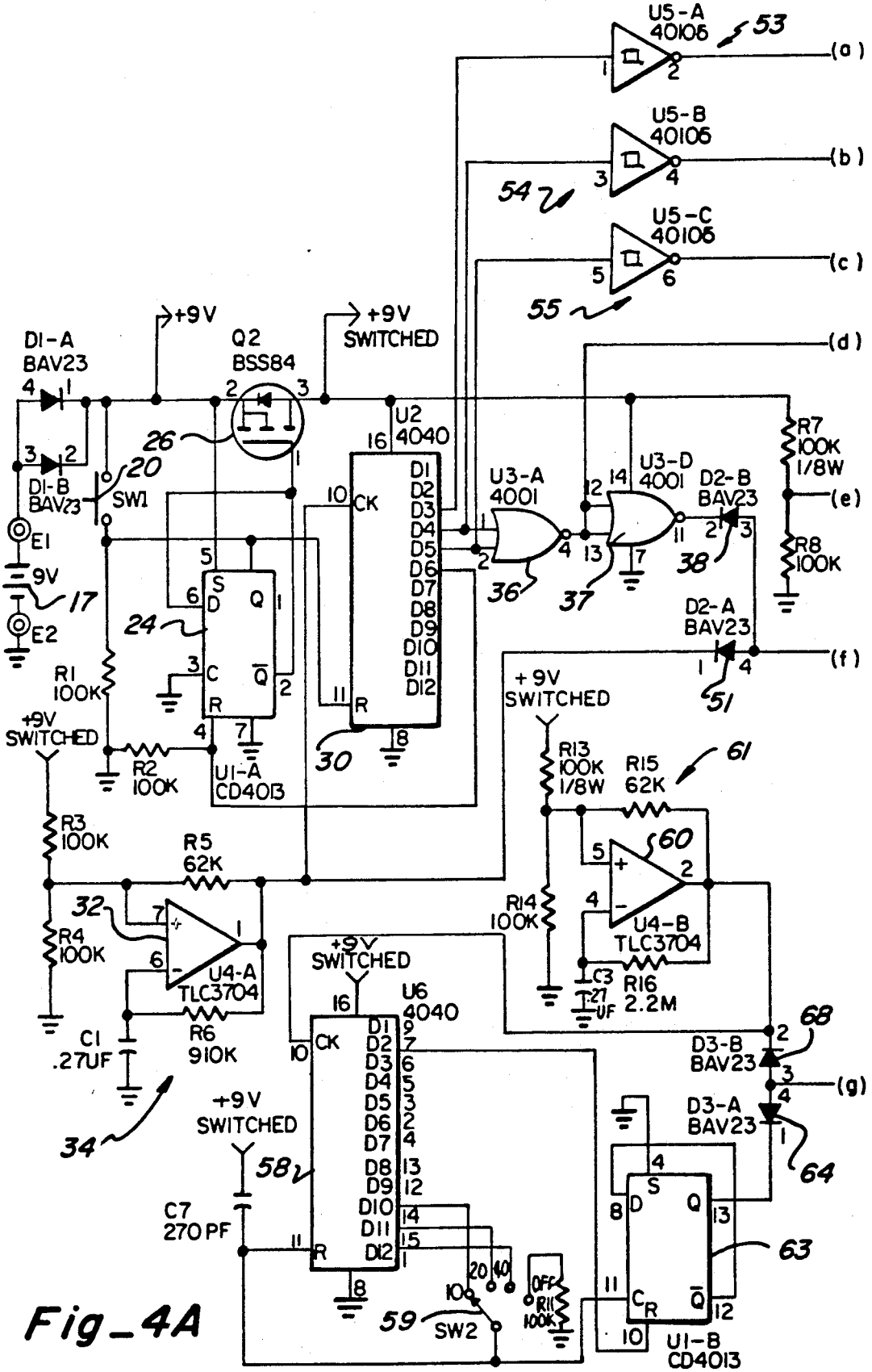
FIGS. 4A and 4B, taken together, form an electrical schematic diagram of the electronics unit.
Figure 4B:
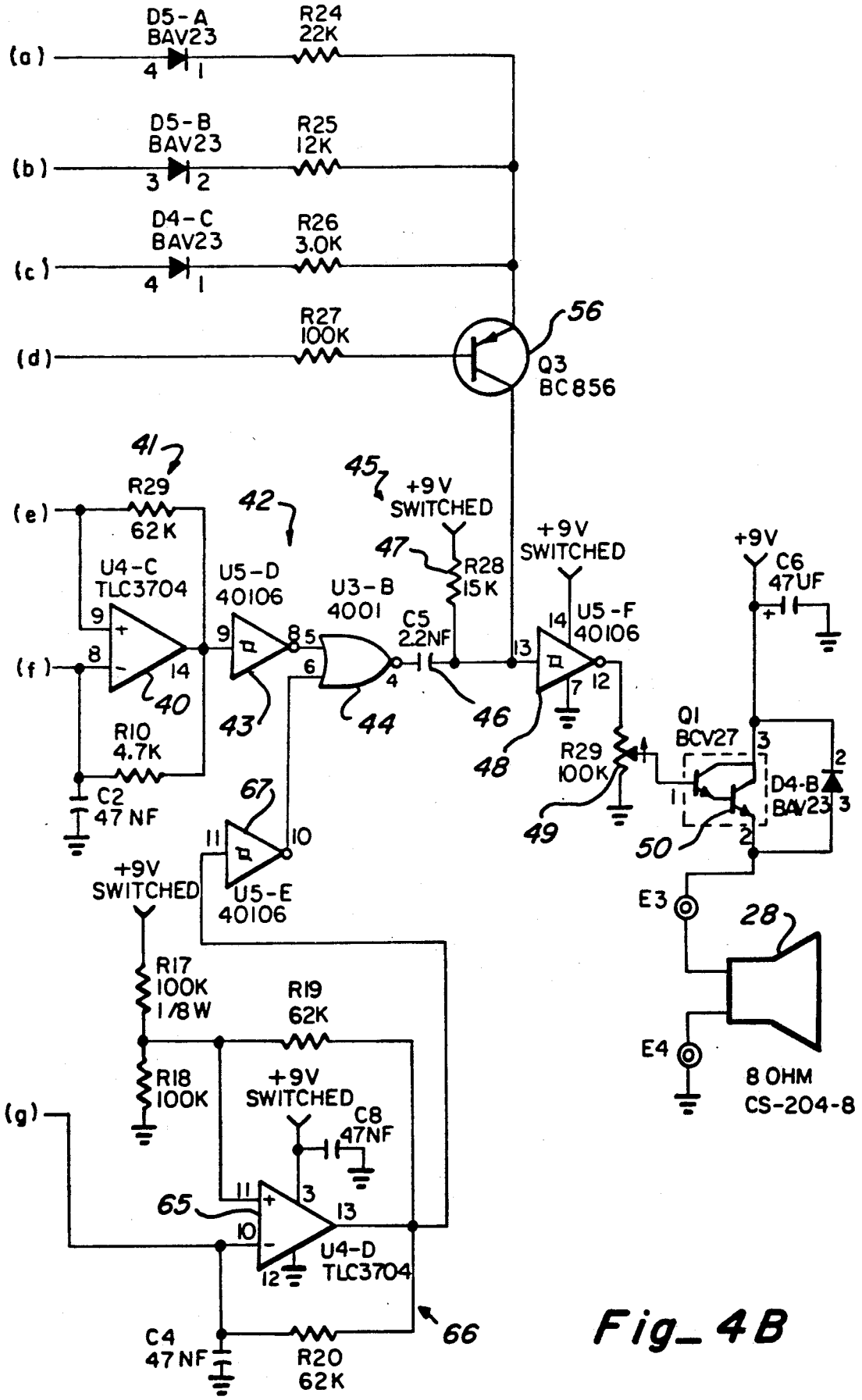

The circuit diagram for accomplishing the foregoing is shown in FIGS. 4A and 4B. As shown, +9 volt battery 17 provides power for electronics unit 15. Pressure switch 20 is connected between the +9 volt power and flip/flop (F/F) 24. When the pressure switch is closed, this causes a change in the output state of F/F 24 to turn on field effect transistor (FET) 26 which acts as an off/on switch. When turned on, the power supply is provided to the remainder of the circuitry with the exception of horn, or beeper, 28 which is directly connected with the positive side of the battery.

Counter 30 is inhibited while pressure switch 20 is closed. A slow rate clock output is provided from the output of comparator 32, which comparator is a part of square wave oscillator 34. When pressure switch 20 is open, counter 30 is no longer inhibited and counts the output pulses from square wave oscillator 34. The output from counter 30 is coupled through NOR gates 36 and 37 and diode 38 to comparator 40 of square wave oscillator 41 (comparator 40 is also connected with oscillator 34 through diode 51). After a short delay of about 5 seconds, an output is coupled through an OR gate 42 (that includes inverter 43 and NOR gate 44) to differentiator 45 (that includes capacitor 46 and resistor 47). The output from the differentiator is coupled through Schmidt trigger/inverter 48, potentiometer 49 and transistor 50 to horn 28 to cause the horn to provide a continuous beep.

The horn is turned off by the pressure switch closing or by counter 30 turning off the electronics unit after ten seconds. An increase in the amplitude of the beep is provided by pulse stretching through use of three parallel connected inverter, diode and resistor arrangements 53, 54 and 55 coupled through transistor 56 to Schmidt trigger/inverter 48.

Counter 58 is provided with a selectable time control 59 (shown in FIG. 4A as 10, 20, 40 minutes or "OFF"). When FET switch 26 is on, this counter starts to count the output from comparator 60, which comparator is a part of square wave oscillator 61. When the count reaches a predetermined time, as selected by selector 59, counter 58 provides an output to F/F 63 to change the state of the flip/flop to thereafter supply an output through diode 64 to comparator 65 of square wave oscillator 66 (comparator 66 is also connected with comparator 60 through diode 68). Oscillator 66 then supplies an output to inverter 67, which inverter is a part of OR gate 42. This output causes a lower pitch beep. An output, Q2, coupled from counter 58 to flip-flop 63 causes the beep to be turned off after two seconds.

After application of initial pressure by the user at commencement of use of the roll, the first result of the turn on is that flip/flop 24 is triggered causing the battery switch transistor 26 to connect power to the rest of the components. The flip/flop is CMOS circuitry having the virtue of extremely low static current drain, less than 1 microampere. This gives a gives a seven year battery life in standby. The second effect of the first switch closure is to start the exercise timer.

So long as the switch is holding the logic line high, it keeps the exercise timer running and the delay timer is reset so that the beeper alarm is disabled. As soon as the switch opens, the delay timer counts up to five seconds. Then, providing the switch is still open, the beeper alarm and beeper timer enable. The alarm continues until the beeper timer times out, after another five seconds. If the pressure switch closes during the alarm, the beeper is disabled and all but the exercise timer are reset. If the pressure switch does not close, then the time out of the beeper timer causes the battery switch flip/flop to reset, putting the whole unit to sleep.

As can be appreciated from the foregoing, this invention provides an improved lumbar roll with an alerting capability.

What is claimed is:

1. A lumbar roll having alerting capability, said lumbar roll comprising:

resilient means adapted to be compressed by a user;

pressure means at said resilient means for sensing pressure exerted by a user on said resilient means, said pressure means providing an output indicative of sensed user applied pressure;

processing means responsive to said output from said power means, providing at least one output indicative of the occurrence of a preselected condition; and indicating means connected with said processing means for indicating the occurrence of said preselected condition.

2. The lumbar roll of claim 1 wherein said resilient means is made of readily compressible foam material.

3. The lumbar roll of claim 2 wherein said foam material is surrounded by a casing having strap means thereon.

4. The lumbar roll of claim 1 wherein said pressure means is a pressure switch.

5. The lumbar roll of claim 1 wherein said processing means includes timing means for determining the occurrence of said preselected condition.

6. The lumbar roll of claim 1 wherein said counter means provides an output indicative of one of poor posture and a need for exercise as said predetermined condition.

7. The lumbar roll of claim 1 wherein said processing means provides outputs indicative of at least two preselected conditions.

8. The lumbar roll of claim 1 wherein said indicating means is audible.

9. The lumbar roll of claim 1 wherein said processing means includes means providing at least one of automatic turn-on and automatic turn-off.

10. A lumbar roll having alerting capability, said lumbar roll comprising:

resilient means adapted to be compressed by a user;

pressure switch means at said resilient means for sensing pressure applied to said resilient means by said user, said pressure switching means providing an output indicative of sensed applied pressure;

electronic means at said resilient means, said electronic means including first and second means, responsive to said output from said pressure switch means, for providing first and second signals indicative of first and second predetermined conditions; and indicating means connected with said electronic means for receiving said first and second signals and, responsive thereto, indicating the occurrence of said first and second conditions.

11. The lumbar roll of claim 10 wherein said first means includes timing means for causing said first condition to be indicated if said pressure switch means is opened for a first predetermined timing period.

12. The lumbar roll of claim 10 wherein said second means includes timing means for causing said second condition to be indicated if said pressure switch means remains closed for a second predetermined timing period commencing when said pressure switch is closed.

13. The lumbar roll of claim 10 wherein said pressure means includes at least one of means for automatically turning on said electronic means and means for automatically turning off said electronic means if said pressure switch remains open for a predetermined period of time.

14. The lumbar roll of claim 10 wherein said electronic means includes means for automatically turning off said electronic means if said pressure switch remains open for a predetermined time.

15. A lumbar roll having alerting capability, said lumbar roll comprising:

readily compressible foam material adapted to be compressed by a user;

a casing surrounding said foam material;

a pressure switch within said casing for sensing pressure applied to said foam material within said casing by said user, said pressure switch providing an output indicative of sensed applied pressure;

electronic means within said casing, said electronic means including first timing means, responsive to said output from said pressure switch, for providing a first signal upon expiration of a first timing period during which said pressure switch remains closed to indicate a need for exercise, said electronic means also including second timing means, responsive to said output from said pressure switch, for providing a second signal if said pressure switch is opened for a second timing period to indicate bad posture; and indicating means connected with said electronic means for receiving said first and second signals and, responsive to receiving said first signal indicating said need for exercise, and, responsive to receiving said second signal, indicating said bad posture.

16. The lumbar roll of claim 15 wherein said first and second timing means includes counting means and oscillator means.

17. The lumbar roll of claim 16 wherein said counter is a flip/flop and wherein said oscillator means is a square wave oscillator supplying pulses to said counter.

18. The lumbar roll of claim 15 wherein said electronic means includes means for automatically turning on said electronic means when said pressure switch initially senses user pressure.

19. The lumbar roll of claim 14 wherein said electronic means includes means for changing the pitch of said indicating means.

* * * * *